US005386591A

United States Patent [19]

Canan

[11] Patent Number: 5,386,591

[45] Date of Patent: Feb. 7, 1995

[54] DISCUS TRAINING GLOVE

[76] Inventor: Karen J. Canan, P.O. Box 115, Bloomery, W. Va. 26817

[21] Appl. No.: 928,745

[22] Filed: Aug. 13, 1992

[51] Int. Cl.[6] ..... A41D 19/00

[52] U.S. Cl. ..... 2/160; 2/20; 2/161.1; 2/162

[58] Field of Search ..... 2/20, 160, 161 A, 162, 2/16, 158, 159, 161.1, 161.6

[56] References Cited

U.S. PATENT DOCUMENTS

| | | | |
|---|---|---|---|
| 272,945 | 2/1883 | Chambers | 2/162 |
| 575,362 | 1/1897 | Luther | 2/162 |
| 889,397 | 6/1908 | O'Shaughnessy | 2/161 A |
| 906,856 | 12/1908 | Bernard | 2/162 |
| 3,124,806 | 3/1964 | Campbell | 2/161 A |
| 3,203,006 | 8/1965 | Shirey | 2/161 A |
| 3,835,472 | 9/1974 | Duggins | 2/161 A |
| 3,890,649 | 6/1975 | Diggins | 2/161 A |
| 4,034,979 | 7/1977 | Wester | 2/161 A |
| 4,051,553 | 10/1977 | Howard | 2/20 |
| 4,071,913 | 2/1978 | Rector | 2/20 |
| 4,326,706 | 4/1982 | Guthrie | 2/160 |
| 4,330,120 | 5/1982 | Netti | 2/161 A |
| 4,575,075 | 3/1986 | Tarbox | 2/161 A |
| 4,590,625 | 5/1986 | Keim | 2/161 A |
| 4,624,016 | 11/1986 | Luevano | 2/20 |
| 4,684,123 | 8/1987 | Fabry | 2/161 A |
| 4,700,405 | 10/1987 | Sternberg | 2/20 |
| 4,813,079 | 3/1989 | Reitzel | 2/161 A |
| 4,911,433 | 3/1990 | Walker | 2/161 A |
| 5,027,439 | 7/1991 | Spector | 2/161 A |
| 5,214,799 | 6/1993 | Fabry | 2/20 |

*Primary Examiner*—Clifford D. Crowder
*Assistant Examiner*—Diana L. Biefeld
*Attorney, Agent, or Firm*—Walter G. Finch

[57] ABSTRACT

A discus training glove for use in adding to the competitive capability of discus throwers is provided herein. The present invention proposes to add an evenly distributed amount of weight to the glove of the discus thrower. The weight will be inserted and contained in a pouch on the back hand side of the glove, and if desired, additional weight in the form of a weighted pad can be attached to the pouch on the glove. By adding a balanced weight to the top portion of the hand, the discus thrower will become tolerant and adjusted to the weight added. Thus, upon removal of the additional weight, the discus thrower will have the ability to well surpass his or her best previous throws.

7 Claims, 3 Drawing Sheets

DISCUS TRAINING GLOVE

BACKGROUND OF THE INVENTION

This invention relates to athletic training equipment, and more particularly, to a training glove for the discus thrower which will allow the discus thrower to become adjusted to higher throwing weights, thereby increasing the athlete's performance in competition.

BEST KNOWN PRIOR ART

The best known prior U.S. art is as follows:

304,556
651,701
1,915,617
3,597,765
4,224,692
4,519,097
4,546,495
4,624,016

The Petersen U.S. Pat. No. 304,556 introduces a water tight glove with an elastic wrist part. The U.S. Pat. No. 651,701 issued to Delamere shows a glove complete with laces on its side.

The U.S. Pat. No. 1,915,617 issued to Potter teaches a fingerless golf glove designed to protect the hands of a player. The Chappell, et. al. U.S. Pat. No. 4,519,097 describes a fingerless protective glove for playing video games whose means of securement is a Velcro strip. Yet another fingerless glove for use in weightlifting which relieves excess strain and pain in the arm and hands is the subject of the Castillo U.S. Pat. No. 4,546,495.

The U.S. Pat. No. 4,624,016 issued to Luevano teaches an athletic glove with a laminated cushion covering the underside of the hand which will prevent stress, pain, or injury. Better gripping via an overlying gripping surface of relatively high friction material on its inner surface is the subject of the Stanton U.S. Pat. No. 3,597,765. The Sundberg U.S. Pat. No. 4,224,692 describes a freight handling glove with ventilation means to add to the comfort of the user when handling objects.

SUMMARY OF THE INVENTION

The art does not, however, seem to mention a glove which has as its purpose the advancement in competitiveness of the discus thrower. The present invention has this as its purpose and seeks to accomplish this by overcoming a typical dilemma faced by the discus thrower.

The discus is a constant weight. The typical discus thrower's muscles are inclined to become tolerant to that specific weight. Therefore, when a discus thrower reaches the apex of his or her ability with the weight of the discus, the thrower is often unable to make competitive gains above and beyond his or her average throwing distance.

Since the weight of the discus cannot be changed, the present invention proposes to add an evenly distributed amount of weight to the glove of the discus thrower. By adding a balanced weight to the top portion of the hand, the discus thrower will become tolerant and adjusted to the weight added. Thus, upon removal of the additional weight, the discus thrower will have the ability to well surpass his or her best previous throws.

OBJECTS OF THE INVENTION

It is an object of this invention to provide a discus training glove for use by the competitive discus thrower.

Another object of this invention is to provide a novel discus training glove with a pouch on the face coveting the top portion of the hand which may be filled with a weighted material such as sand.

Still another object of this invention is to provide a novel discus training glove whose design will allow an additional weight to be added to the filled pouch covering the top portion of the hand.

Still other objects of this invention are to provide a discus training glove which is secured to the wearer by a strap means around the wrist portion of the arm and which is also comfortable to the wearer in operational use.

And to provide a novel discus training glove which, when used in conjunction with discus throwing, will allow the arm and hand muscles to adjust to higher throwing weights and ultimately add to the competitiveness of the discus thrower is yet another object of this invention.

BRIEF DESCRIPTION OF THE DRAWINGS

These and other attendant advantages of this invention will become more obvious and apparent from the following detailed specification and accompanying drawings in which.

DESCRIPTION OF THE PREFERRED EMBODIMENTS OF THE INVENTION

Referring now to FIGS. 1 to 8 of the drawings, there is shown the preferred embodiment of a discus training glove 10, whose features assist the competitive discus thrower in improving his or her best throws.

Figure 2:
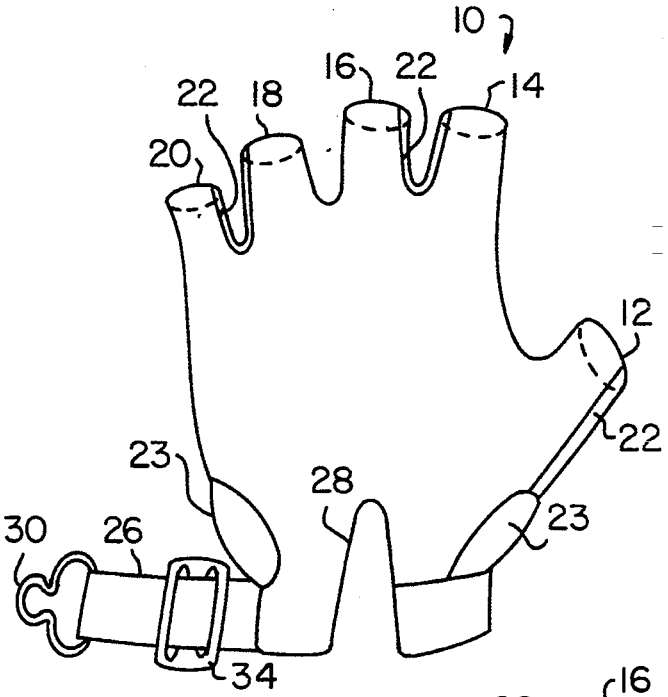
FIG. 2 is a view of the palm side of the glove of FIG. 1, also as seen on the right hand.
Figure 3:
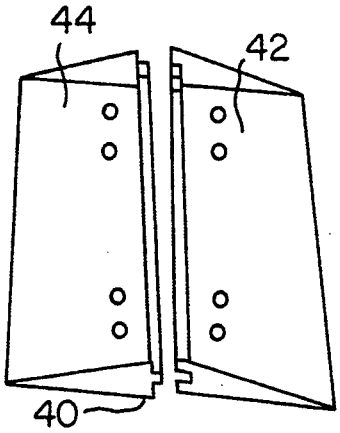
FIG. 3 is a detailed view of an interlocking member of the discus training glove of FIG. 1.
Figure 1:
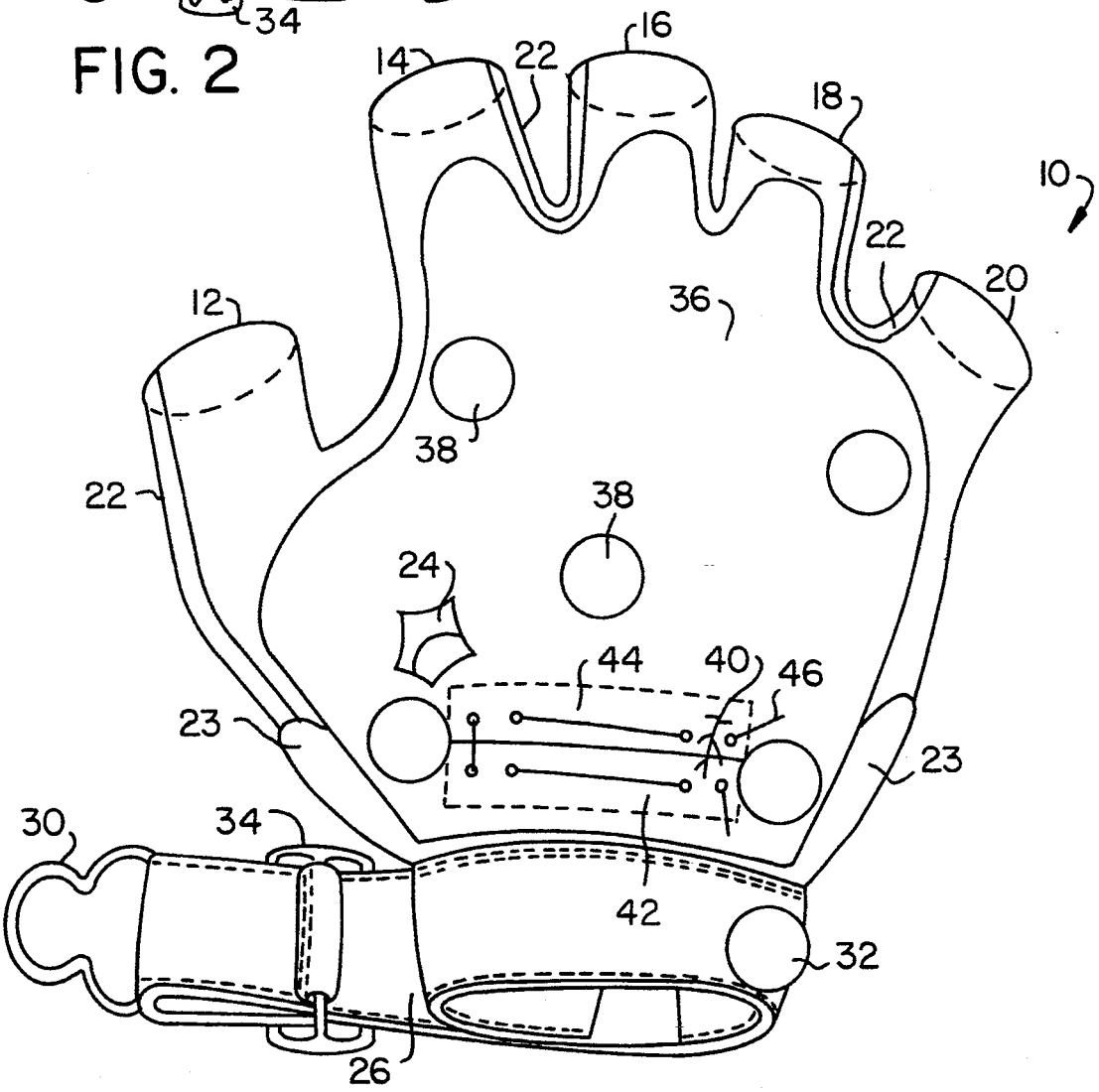
FIG. 1 is a pictorial view of a discus training glove incorporating features of this invention, as seen on the back side of the right hand.

FIG. 1 shows the glove 10 as it is seen on the back of the right hand. The finger stalls 14,16,18,20 and thumb stalls 12 extend only to and not beyond the end of the proximal phalanx. The fabrics on the exterior portion of the thumb stall 12, the fabrics between the forefinger stall 14 and the middlefinger stall 16, and also the fabrics between the ringfinger stall 18 and tile littlefinger stall 20 are joined together with elastic strips 22. The fabrics between the thumb stall 12 and the forefinger stall 14, the middlefinger stall 16 and the ringfinger stall 18, and also the exterior portion of the littlefinger stall 20 are joined together by stitching in such a way as to prevent bulkiness. Bulkiness would tend to cause blisters to form on the hand.

The cushion pads 23 are sewn directly to the fabric of the palm, to the elastic strip 22 on the exterior of the thumb stall 12, and to the fabrics on the back side of the hand. The cushion pads 23 are attached in such a manner as to cause direct contact between themselves and tile hand, thereby adding comfort and protection in critical areas to the hand of the user.

A metal plate 24 is secured by stitching between a first and second layer of fabric on the back side portion of the hand. The metal plate 24 serves to balance the weight acting on the discus glove 10. Securing the metal plate 24 is necessary to prevent its movement and interference with the fixation of the hand and wrist.

A strap means 26 begins at the lower inside edge of the inner face split 28, closest to the thumb stall 12 on the palm side of the hand and continues attached to the outer wrist portion of the glove 10 until just after the wrist bone. As the strap means 26 attaches to the wrist portion of the glove 10, it also attaches to and partially covers the cushion pads 23. The strap means 26 is illustrated clearly in FIGS. 1 and 2. On to the outermost edge of the strap means 26 is a latch 30. The latch 30 connects to a latch retaining pin 32 mounted on the strap means 26, thereby tightly securing the discus glove 10 to the throwing hand and wrist. A buckle 34 is placed between the latch 30 and the glove 10 to hold the very end of the fabric, thereby allowing the strap means 26 to become adjustable. The strap means 26 is constructed of multiple layers of a suitable material sewn together, such as gaberdine (a blend of wool and cotton).

The pouch 36, extending into the forefinger stall 14, middlefinger stall 16, ringfinger stall 20 and continuing down to just before the bend of the wrist, is attached to the top layer of fabric by stitching. As the pouch 36 nears the wrist, it also attaches to and partially covers the cushion pads 23. The pouch 36 can be filled with a weighted material such as sand. The additional weight of the material in the pouch 36, balanced by the metal plate 24, serves to strengthen the thrower's arm and hand muscles and allow the thrower to achieve greater throwing distances.

A plurality of male snaps 38 are attached to the upper portion of the pouch 36. In the drawing provided, five male snaps 38 are drawn. The exact number, however, is not relevant. As drawn, the first and second male snaps 38 are positioned on each side of an interlocking member 40. The third and fourth male snaps 38 are located just below the knuckle of the forefinger stall 14 and the knuckle of the littlefinger stall 20, respectively. The fifth male snap 38 is centered between the other four male snaps 38. The purpose of the male snaps 38 is to allow an additional weighted pad attachment 48 to be secured to the pouch 36.

The interlocking member 40 has two functions: it provides an entrance into the pouch 36 for the weighted matter and it provides a sealing means to contain the weighted matter. The interlocking member 40 is comprised of two parts. The first is the female member 42 and the second is the male member 44. The female and male members 42 and 44 are attached to the upper portion of the pouch 36. The female member 42 is closest to the wrist so that the weighted material going into the pouch 36 does not become entrapped in the crevice. The male member 44 is positioned farthest from the wrist. A string 46 passes through a plurality of holes in such a way as to allow the insertion of weighted matter into the pouch 36 while still having the severity to contain the weighted matter therein. The drawings show eight holes provided in the interlocking member 40 for the string 46 to pass, but the exact number is not important to the concept of the invention. The interlocking member is shown in detail in FIG. 3, and inserted into the pouch in FIG. 7.

Figure 4:
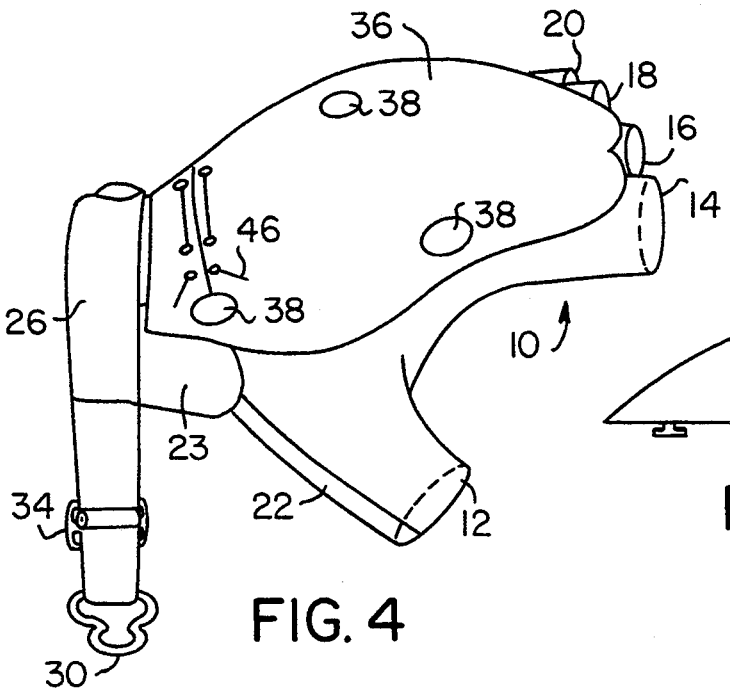
FIG. 4 is a side view of the discus training glove of FIG. 1, but now as seen on the left hand.

FIG. 4 is a side view of the discus glove 10 as seen on the left hand showing the position of the thumb stall 12, the cushion pad 23, the thickness of the pouch 36, and the wrist strap means 26 as well as the overall general appearance.

Figure 6:
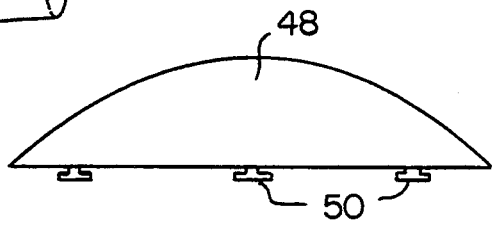
FIG. 6 is a side view of the weighted pad attachment of FIG. 5, showing its thickness.
Figure 7:
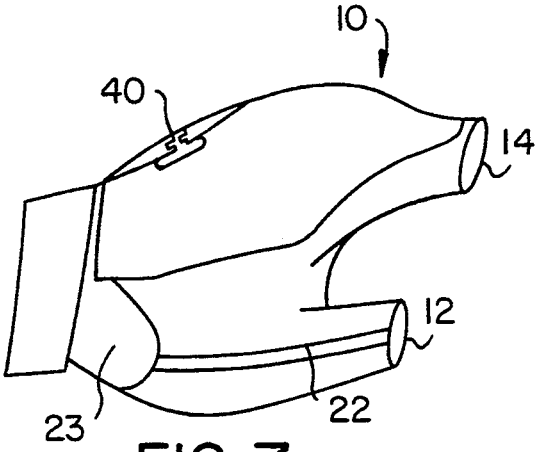
FIG. 7 is a sectional view of a pouch feature of the discus training glove of FIG. 1, showing the interlocking member as it is placed inside the glove.
Figure 5:
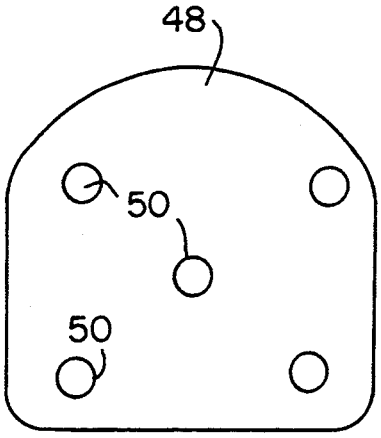
FIG. 5 is a bottom view of a weighted pad attachment used in conjunction with the discus training glove of FIG. 1.

FIG. 5 and 6 depict a weighted pad attachment 48 for use in conjunction with the glove 10. The weighted pad attachment 48 may be fastened to the pouch 36 by means of a plurality of female snaps 50 located on the bottom portion of the weighted pad attachment 48 and seen in FIG. 5. These female snaps 50 correspond exactly in position to the male snaps 38 on the pouch 36, thereby permitting rigid fixation of the pad attachment 48 to the pouch 36. FIG. 6 is a side view of the weighted pad attachment 48 showing its thickness. The weighted pad attachment 48 may be used in conjunction with a full pouch 36 to add even more weight to the top of the thrower's hand, thereby further increasing his or her performance.

Figure 8:
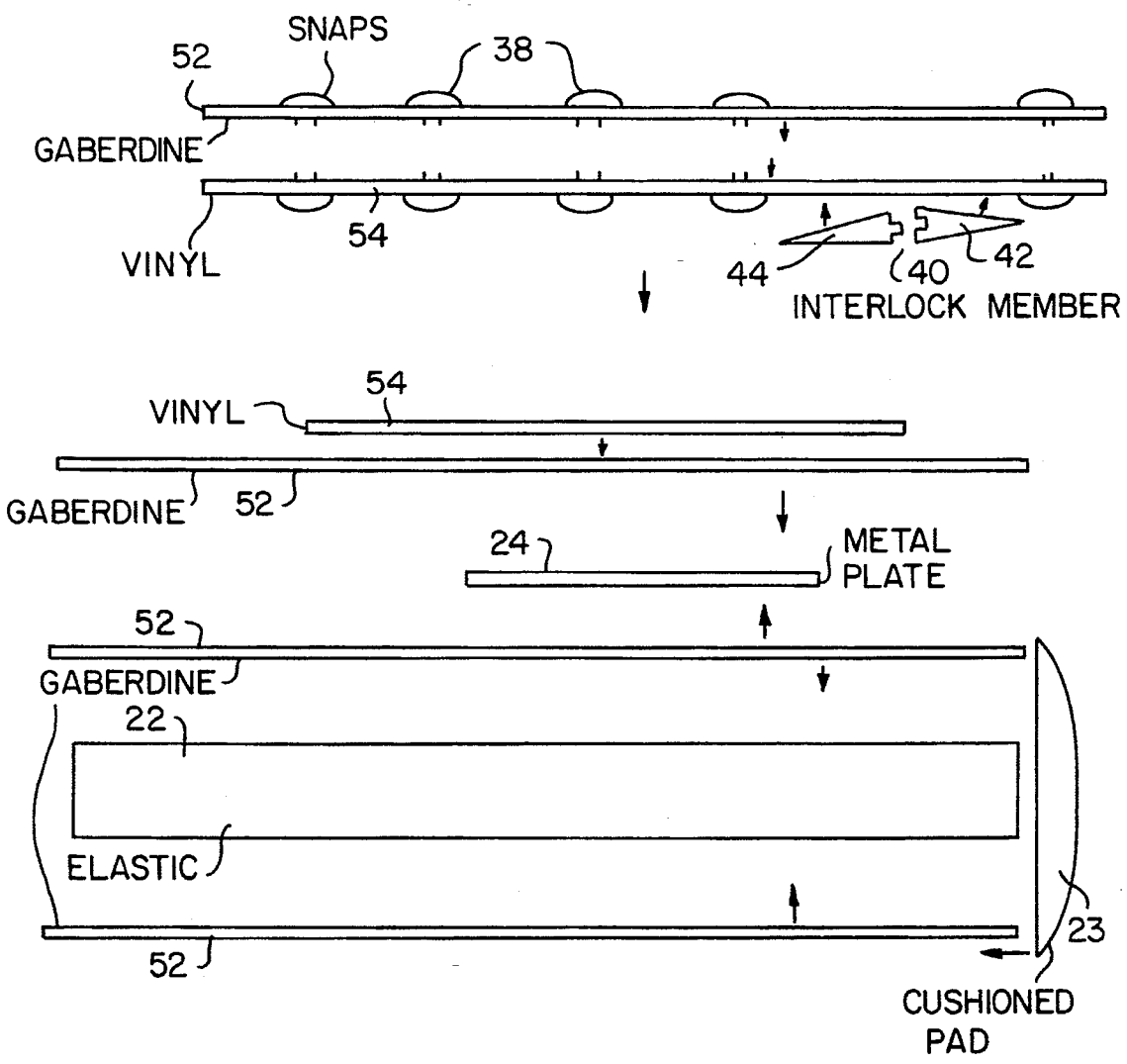
FIG. 8 is a section assembly view illustrating how each portion of the discus training glove of FIG. 1 attaches to one another.

FIG. 8 is an assembly view of the glove 10 illustrating how each portion of the glove 10 attaches to one another. First, consider the assembly of the pouch 36. A sheet of gaberdine 52 is sewn on to a sheet of vinyl 54. The interlocking member 40 is then attached. The plurality of male snaps 38 are then positioned. The string 46 may now be inserted through the multiplicity of holes provided in the interlocking member 40 to close the top portion of the pouch 36. The bottom portion of the pouch 36, which is simply another sheet of vinyl 54, is now attached to the top portion, thereby completing the pouch assembly.

The next phase involves connection of the upper and lower portions of the glove 10, adding cushion pads 23, the strap means 26, and finally the pouch 36 to complete the finished product. The upper portion of the glove 10 has three parts: the first sheet of gaberdine 52, the metal plate 24, and the second sheet of gaberdine 52. The sheets of gaberdine 52 sandwich the metal plate 24 in such a way that it cannot move and does not interfere with wrist flexibility or the positioning of the pouch 36. The lower portion of the glove 10 is then attached by means of specifically placed elastic strips 22 and stitching.

Lastly, the cushion pads 23 are incorporated. The first cushion pad 23 is sewn on to the thumb stall 12 side of the glove 10, next to the wrist. This will keep the weight of the glove 10 film bruising the hand. This cushion pad 23 will connect the upper portion, elastic strips 22, and lower portion of the glove together. The second cushion pad 23 is placed on the littlefinger stall 20 side of the glove 10, next to the wrist. This cushion pad 23 will also keep the hand from becoming bruised or sore. This cushion pad 23 will connect the upper and lower portions of the glove 10 while remaining in direct contact with the hand.

Lastly, the pouch 36 may be placed upon the top layer of fabric on the back side of the hand and sewn on to the top of the glove 10. Multiple stitching will be required.

What is claimed is:

1. A discus training glove for enhancing the competitive ability of discus throwers, comprising, a smooth palm portion for releasing a discus and formed of a suitable fabric, a backhand portion formed of a suitable fabric and having at least two layers, a thumb stall, a forefinger stall, a middlefinger stall, a ringfinger stall, a littlefinger stall, an elastic strap means for joining said fabric of said palm portion and said fabric of said backhand portion on the exterior portion of said thumb stall, between said forefinger stall and said middlefinger stall, and also between said ringfinger stall and said littlefinger stall, a cushion pad means for protecting a user's hand against bruising and soreness in critical areas, a strap means for tightly securing said glove to said user's hand, a pouch means for the addition of a weighted material on to the back side of said user's hand, a metal plate means positioned between said layers of said fabric of said backhand portion for evenly distributing and balancing said weighted material, an interlocking member means positioned in said pouch for opening said pouch and allowing entrance of and containing said weighted material in said pouch, and an additional weighted pad attachment for fastening to a top portion of said pouch means.

2. A discus training glove for enhancing the competitive ability of discus throwers as in claim 1, whereby said cushion pad means is constructed from suitable material and wherein said cushion pad means is sewn directly to said fabric of said palm portion, to said. elastic strip means on the exterior of said thumb stall, and to said fabric forming said backhand portion of said glove.

3. A discus training glove for enhancing the competitive ability of discus throwers as in claim 1, whereby said strap means is constructed from multiple stitched layers of a suitable material, and whereby said strap means includes both a latch and a latch retaining pin for rigid attachment to the wrist, and wherein said strap means incorporates a buckle to regulate the length of said strap means, thereby effectively making said strap means adjustable.

4. A discus training glove for enhancing the competitive ability of discus throwers as in claim 1, whereby said pouch means is formed from layers of a suitable material, and whereby said pouch means is secured to said backhand portion of said glove.

5. A discus training glove for enhancing the competitive ability of discus throwers as in claim 4, wherein said pouch means has on its top surface a plurality of male snaps to attach to said weighted pad attachment.

6. A discus training glove for enhancing the competitive ability of discus throwers as in claim 5, whereby said interlocking member comprises a male and a female member, said members positioned together in said pouch means so that said female member is closest to the wrist, and wherein said interlocking member also has a plurality of holes through which a string may pass to adequately secure said weighted material in said pouch means.

7. A discus training glove for enhancing the competitive ability of discus throwers as in claim 5, whereby said weighted pad attachment has a plurality of female snaps on its bottom face which exactly correspond in relative position to said male snaps on the top of said pouch, said male and female snaps allowing said weighted pad attachment to be secured to said pouch means for yet additional weight to be added to the back side of a user's throwing hand.

* * * * *